US006659560B1

(12) United States Patent
Chi

(10) Patent No.: US 6,659,560 B1
(45) Date of Patent: Dec. 9, 2003

(54) OFFICE CHAIR

(76) Inventor: Ching-Hui Chi, No. 24-2, Hsi Wei Street, San Chung City, Taipei Hsien (TW)

( * ) Notice: Subject to any disclaimer, the term of this patent is extended or adjusted under 35 U.S.C. 154(b) by 0 days.

(21) Appl. No.: 10/340,742

(22) Filed: Jan. 13, 2003

(51) Int. Cl.[7] ..... A47C 7/40; A47C 7/54
(52) U.S. Cl. ..... 297/383; 297/411.37
(58) Field of Search ..... 297/353, 383, 297/411.35, 411.36, 411.37

(56) References Cited

U.S. PATENT DOCUMENTS 2,347,859 A * 5/1944 Williams ..... 297/410
3,490,808 A * 1/1970 Siegel ..... 297/153
3,680,915 A * 8/1972 Freedman et al. ..... 297/410
4,102,549 A * 7/1978 Morrison et al. ..... 297/383
4,221,430 A * 9/1980 Frobose ..... 297/353
5,035,466 A * 7/1991 Mathews et al. ..... 297/353
5,839,784 A * 11/1998 Breen ..... 297/383
6,296,313 B1 * 10/2001 Wu ..... 297/411.35

* cited by examiner

*Primary Examiner*—Peter R. Brown
(74) *Attorney, Agent, or Firm*—Rosenberg, Klein & Lee

(57) ABSTRACT

An office chair includes three connecting element fixedly to a bottom of the seat for the back, the left armrest, and the right armrest to be detachably fitted to respectively; each of the back and the armrests has a support plate having several locating holes; the connecting elements allow respective support plates to be slid on; the support plates can't move up to separate from the connecting elements after having been slid onto the latter. Each of the connecting elements has a spring-loaded locating pin fitted thereto, which can be made to engage one of the locating holes of respective support plates to securely fix the support plates to the seat; thus, the back and the armrests can be adjusted in position, and can be detached from the seat for the chair to occupy less space in packing.

3 Claims, 6 Drawing Sheets

OFFICE CHAIR

BACKGROUND OF THE INVENTION

1. Field of the Invention

The present invention relates to an office chair, more particularly to an office chair, which has a back, and armrests detachable from a seat thereof and adjustable in position for suiting the needs of different sitters.

2. Brief Description of the Prior Art

Referring to FIG. 7, a conventional office chair consists of an upper part 2, and a lower part (not shown), which includes a base, a leg, and connecting means, and other elements. The upper part 2 includes a seat 21, a back 23, and a pair of armrests 25; extending from lower ends of the back 23, and the armrests 25 are bent support plates 24, and 26, and the support plates 24, 26 are fixedly joined to a lower side of the seat 21 by means of screws 22. Such office chair can provide a sitter with relatively much comfort but it is also found to have disadvantages as followings:

1. Because it takes relatively much labor to screw the screws 22 into the seat 21, the back 23 and the armrests 25 are usually joined to the seat 21 in factories. Therefore, the office chair can only be separated into two parts, i.e. the upper and the lower parts, and will occupy relatively big space in packing. Consequently, the cost of storage and transportation would be very high, and become a problem of the manufacturers.
2. The back 23 and the armrests 25 are firmly fixed in position therefore they can't be adjusted in position relative to the seat. In other words, both the space between the armrests 25 and the depth of the chair can't be changed to suit sitters of different body sizes; when a big sitter sits on the chair, he/she might feel very uncomfortable because the small space is too small.
3. The owner can't dismantle the upper part of the chair easily, either. Consequently, when the owner of the chair has to move home, carrying the chair might become a problem because of the size of the chair can't be effectively reduced. And, the various parts of the chair upper part, when damaged, can't be replaced with a new one individually.

SUMMARY OF THE INVENTION

It is a main object of the present invention to provide an office chair, which has a back, and armrests that can be easily detached from, and joined to, the seat thereof.

It is another object of the present invention to provide an office chair, of which the back and the armrests are adjustable in position for suiting the needs of different sitters.

It is yet another object of the present invention to provide an office chair, of which the back and the armrests can be securely fitted in position after adjustment.

The office chair includes three connecting element fixedly to the bottom of the seat; each of the back and the armrests has a support plate having aligned locating holes; the support plates can't move up to separate from the connecting elements after having been slid onto the latter. Each of the connecting elements has a spring-loaded locating pin fitted thereto capable of engaging one of the locating holes of respective support plates; thus, the back and the armrests can be adjusted in position and can be easily detached from, and joined to, the seat.

BRIEF DESCRIPTION OF THE DRAWINGS

The present invention will be better understood by reference to the accompanying, wherein.

DETAILED DESCRIPTION OF THE PREFERRED EMBODIMENTS

Figure 1:
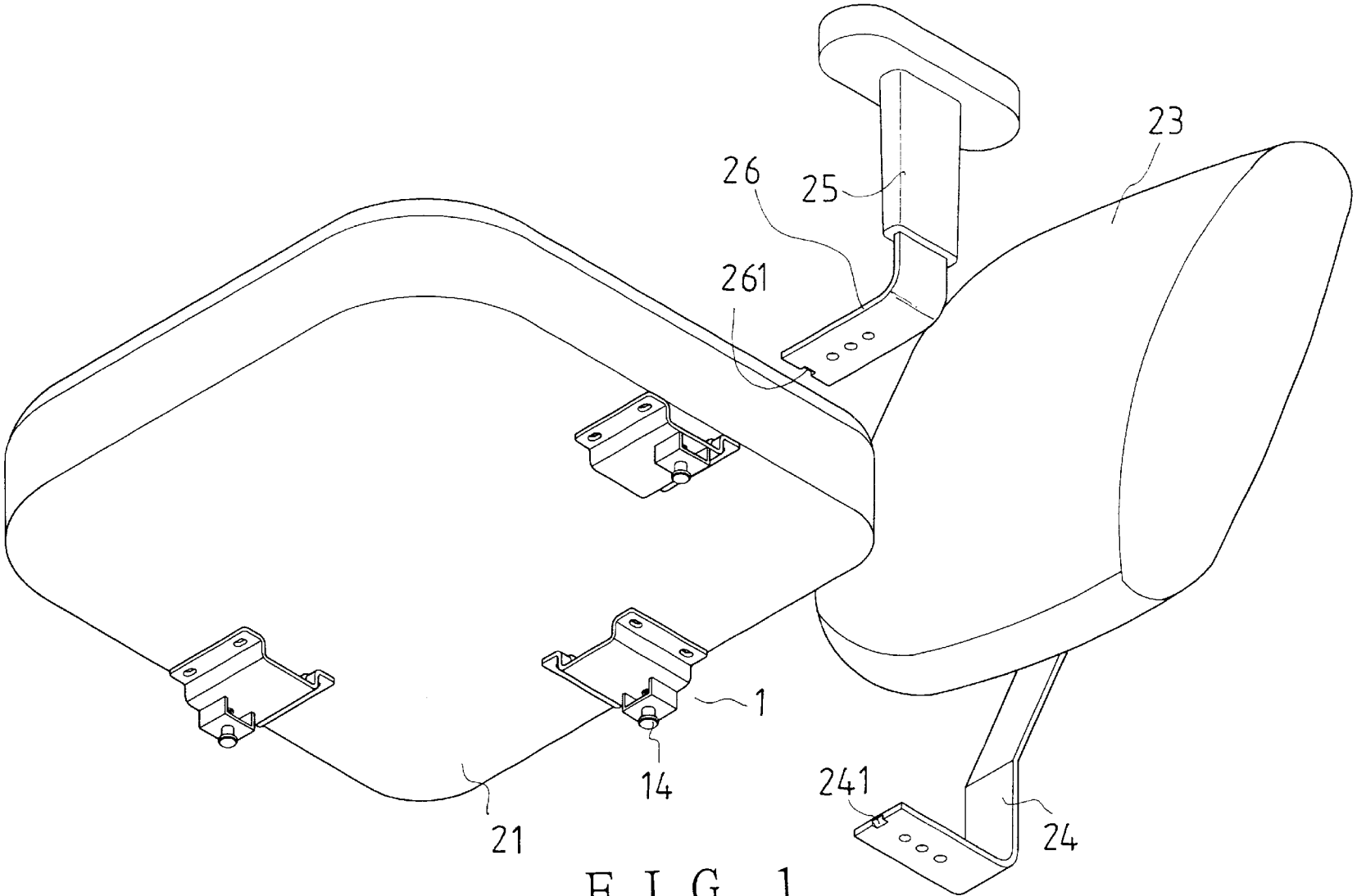
FIG. 1 is a partial exploded perspective view of the office chair according to the present invention.
Figure 2:
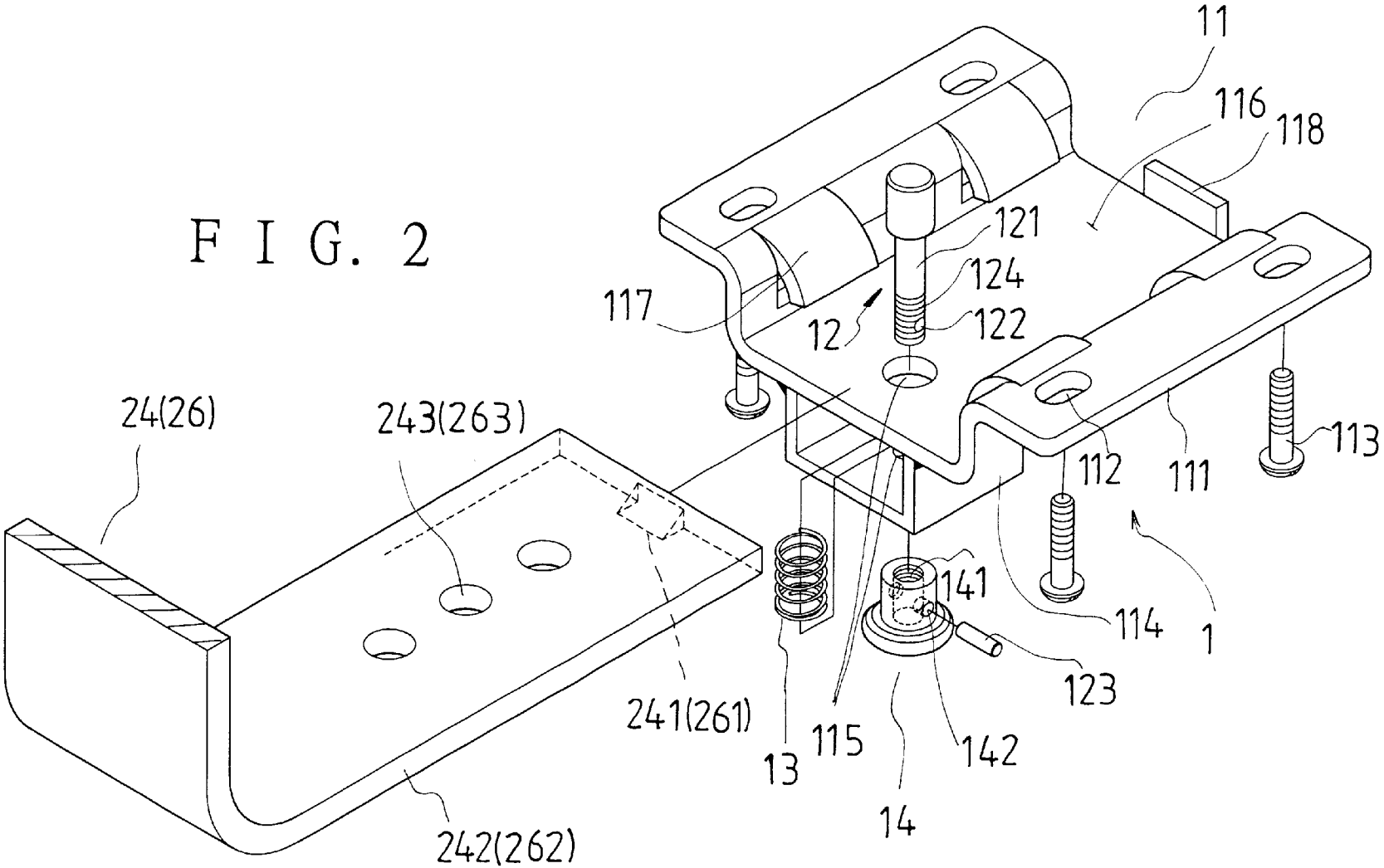
FIG. 2 is another partial exploded perspective view of the office chair according to the present invention.

Referring to FIGS. 1, and 2, an office chair of the present invention includes three connecting elements 1, which are respectively fixed to a rear end, a left edge, and a right edge of a lower side of a seat 21 of the office chair.

Figure 3:
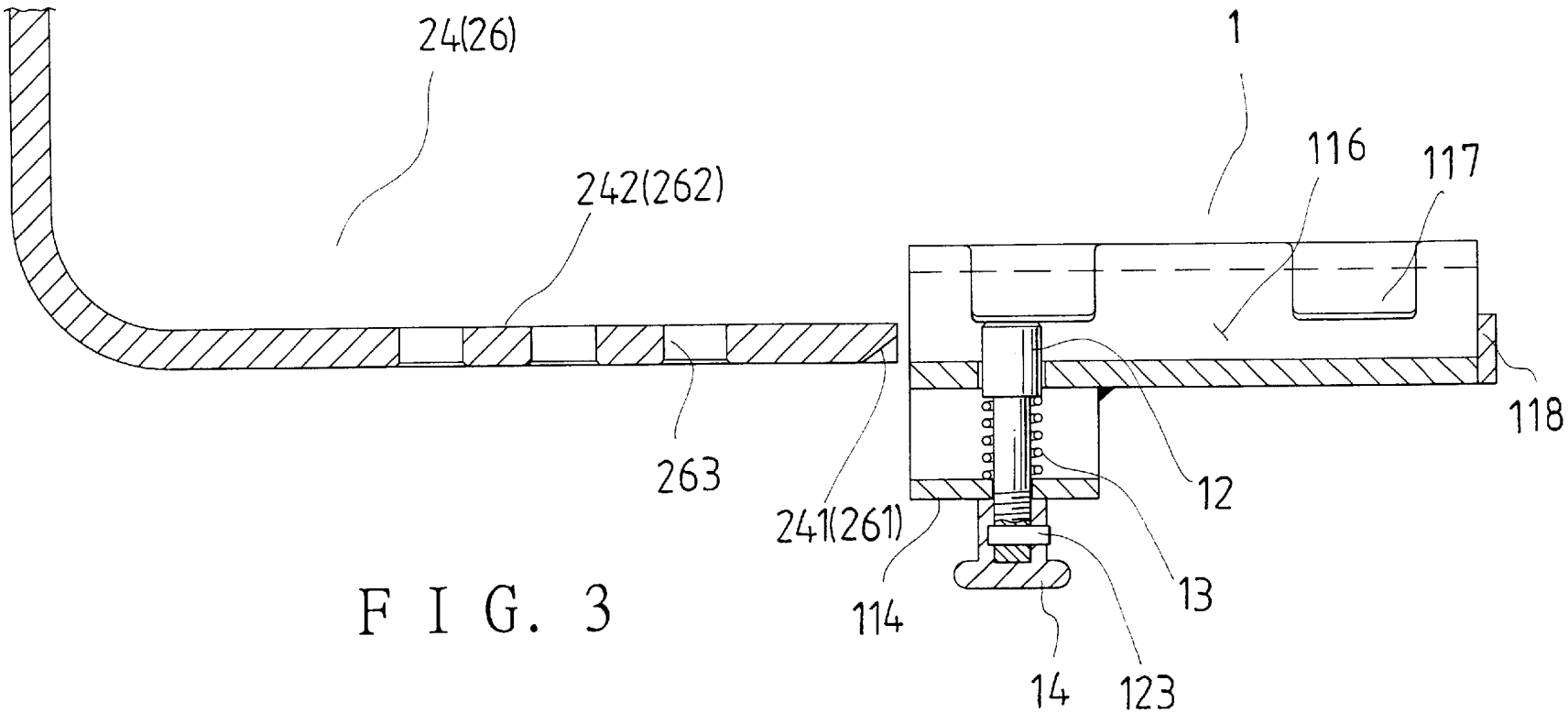
FIG. 3 is a cross-sectional view of a connecting element and a support plate of the office chair of the present invention, before assembly.
Figure 5:
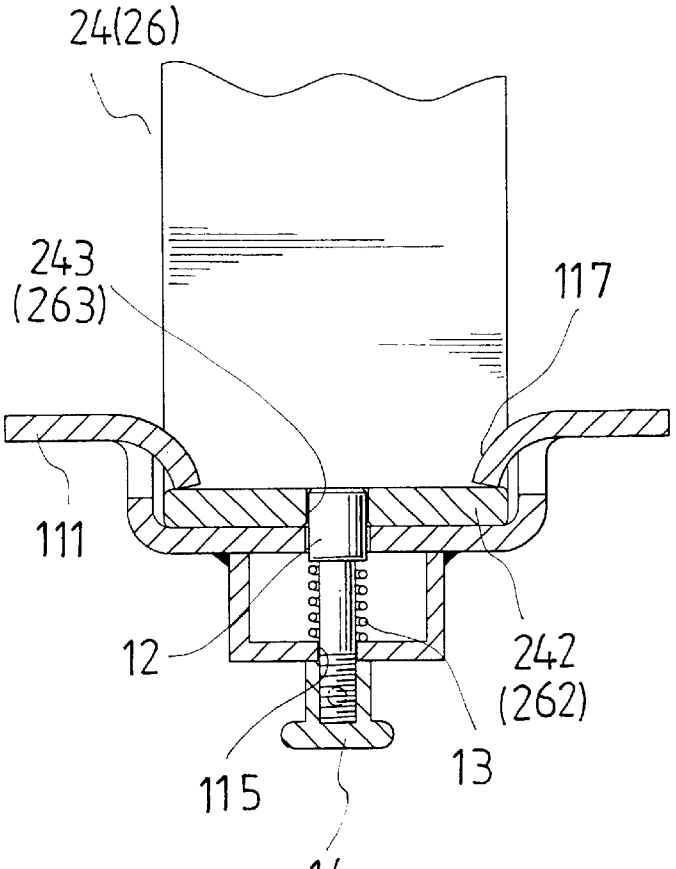
FIG. 5 is another cross-sectional view of a connecting element and a support plate of the present office chair; after assembly.
Figure 4:
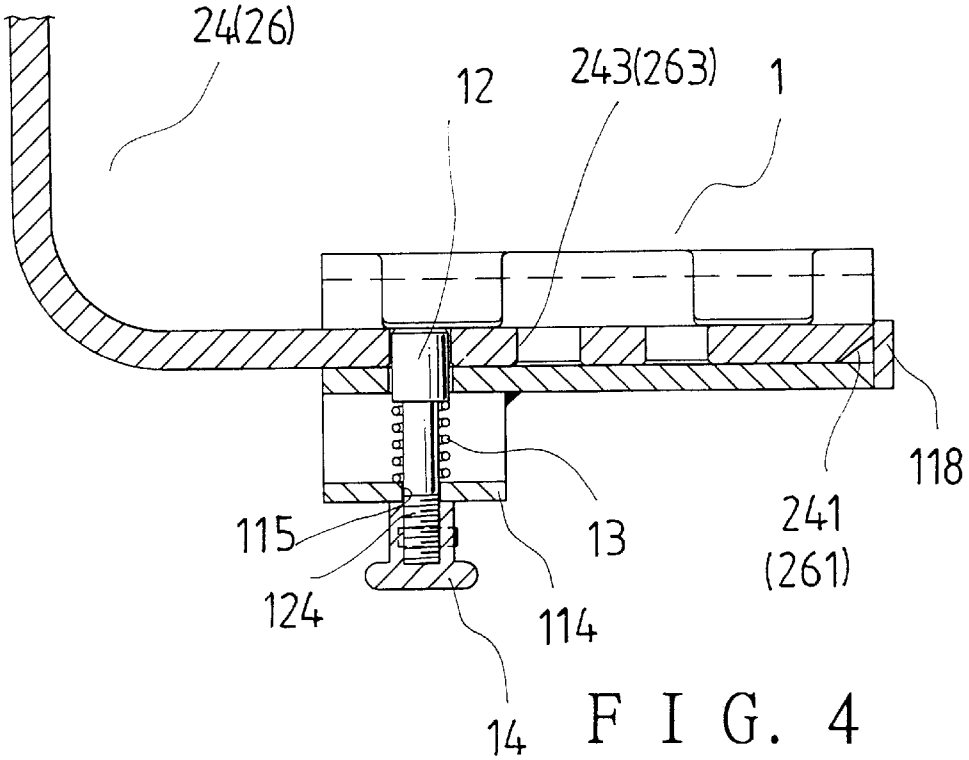
FIG. 4 is a cross-sectional view of a connecting element and a support plate of the office chair of the present invention, after assembly.
Figure 6:
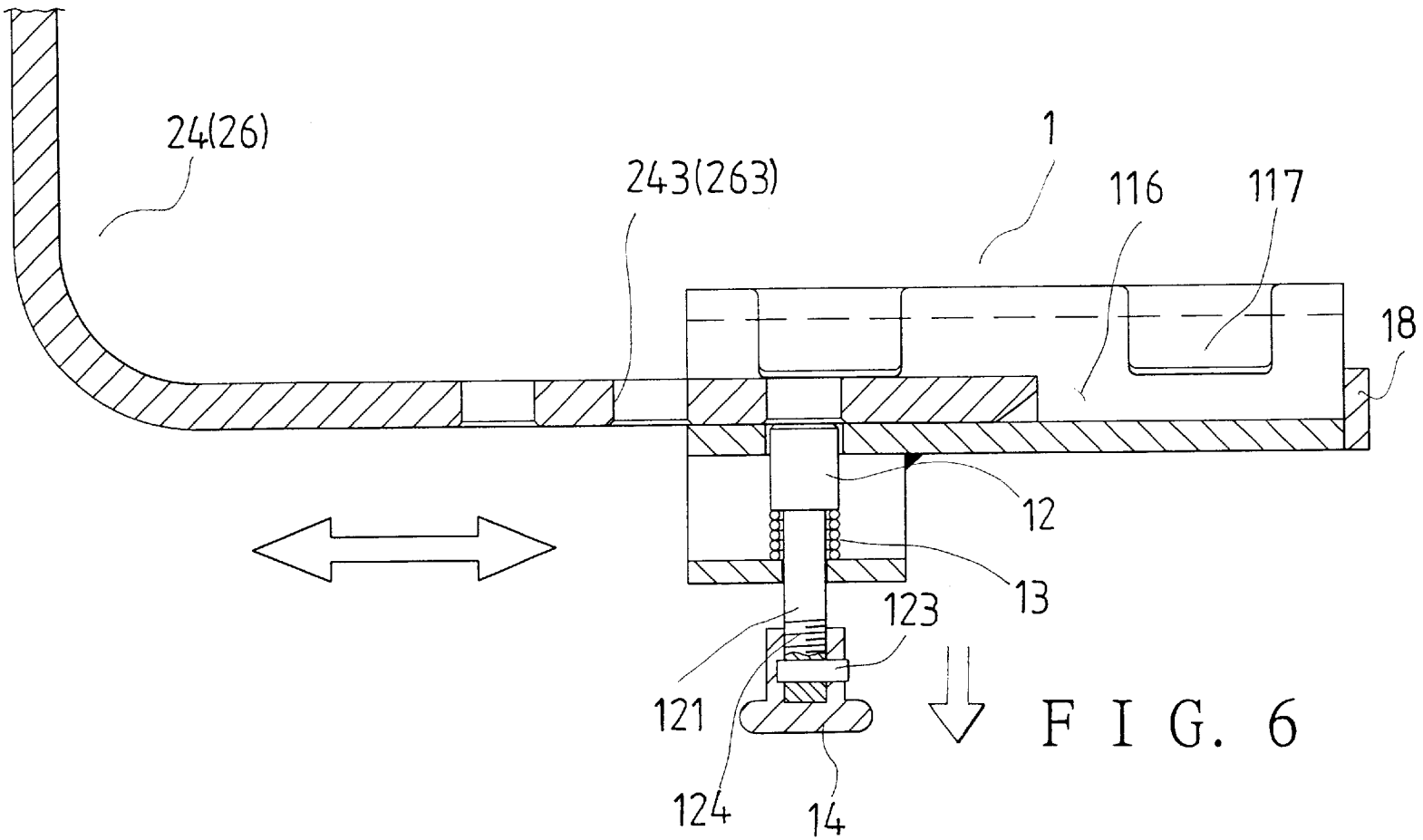
FIG. 6 is a partial view of the present office chair under assembly; and, FIG. 7 is a perspective view of the upper part of the conventional office chair as described in the Background.
Figure 7:
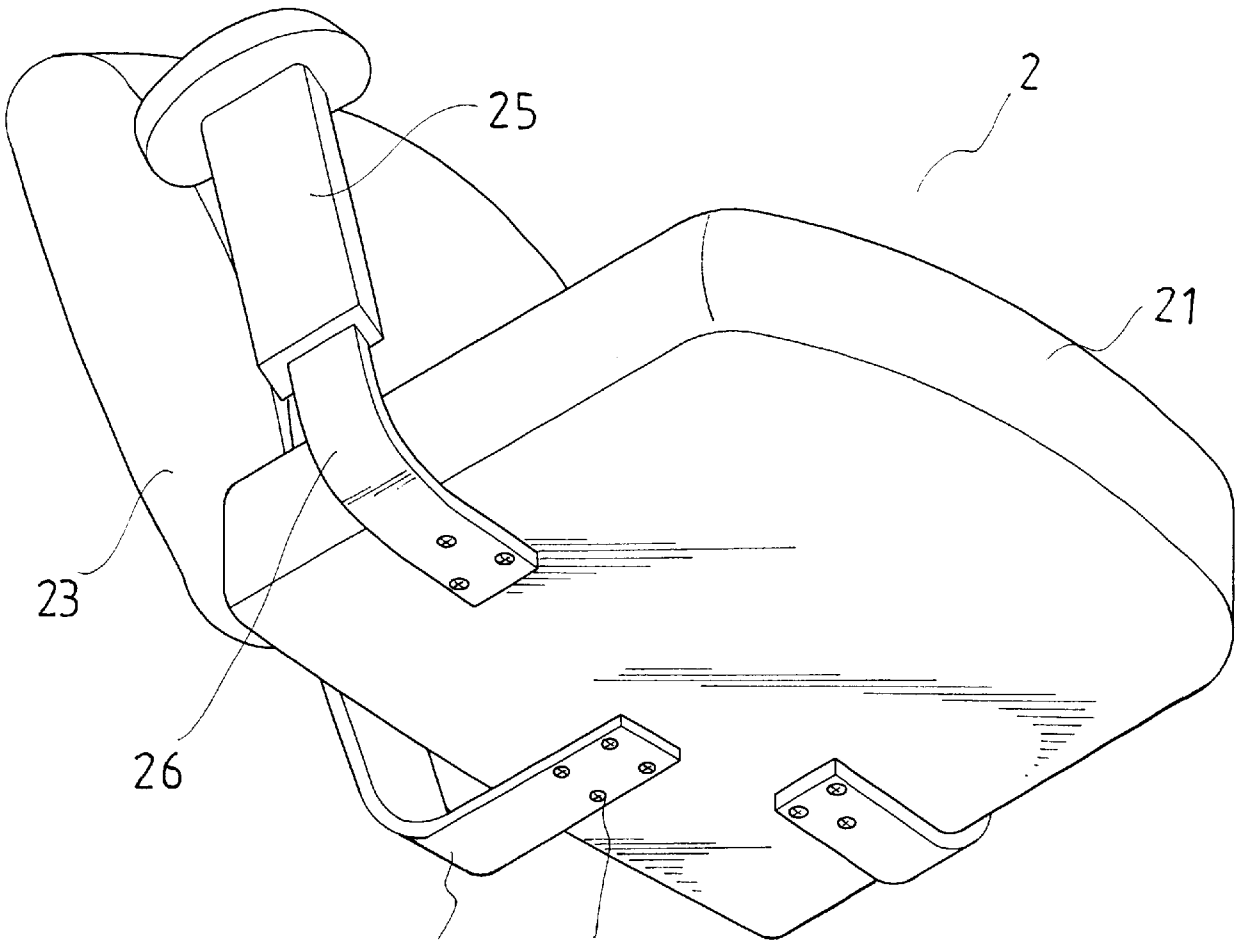
FIG. 7 (PRIOR ART)

Each of a back, a left armrest, and a right armrest of the office chair has a support plate 26, 24, 24 extending down therefrom; each of the support plates 26, 24, 24 has several locating holes 263, 243, 243 formed on a bent insertion portion 262, 242, 242 thereof and has a rounded-off portion 261, 241, 241 at an inward end thereof Referring to FIGS. 2, and 3, each of the connecting elements 1 of the office chair includes a main body 11, a locating pin 12, a spring 13, and a control member 14; each of the main bodies 11 has two wings 11, a middle recess 116 between the wings 111, a projecting base part 114 on the opposite side of the middle recess 116, a stopping plate 118 sticking tip at an inward end of the middle recess 116, and several retaining blocks 117 sticking above two opposite edges of the middle recess 116 to define a holding space between them and the middle recess 116 for allowing a respective support plate 24 (26) to be held therein. The retaining blocks 117 are provided for preventing the support plates 24, 26 from moving up to separate from the connecting elements 1 after the support plates 24, 26 are slid onto tile middle recesses 116.

Each of the wings 111 has through connecting holes 112 so that fixing elements 113 such as screws can secure the connecting elements 1 to the seat of the chair by means of passing the fixing elements 113 through the holes 112 and then screwing the same into the lower side of the seat.

Each of the locating pins 12 has an tipper portion, and a lower portion 121, which is thinner than the tipper one, and which has a transverse pin hole 122, and threads 124 formed a lower end thereof. Each of the control members 14 has a screw hole 141, and a through hole 142 across a lateral side thereof Respectively formed on the middle recess 116, and the projecting base part 114 of each connecting element 1 are through holes 115, and 115' aligned with each other; the through holes 115 are big enough for the thicker tipper portions of the locating pins 12 to pass through; each spring 13 is fitted around respective locating pin's thinner lower portion 121, and is supported by the projecting seat part 114 to bias the pin 12 upwards when the lower portion 121 is passed through the through hole 115'; after the lower portions 121 of the locating pins 12 are passed through the holes 115', they are screwed into respective control members 14, and fixing pins 123 are inserted into the through holes 142 of the control members 14 and the transverse pin holes 122 to prevent the control members 14 from getting loose. Thus, the locating pins 12 normally stick up from corresponding middle recesses 116 to a locking position capable of engaging the locating holes of corresponding support plates 24 (26), and can be moved down to a disengaged position, in which they are lower than corresponding middle recesses 116, by means of pulling the control members 14 downwards.

After the support plates 24, 26 are inserted between the spaces defined by the retaining blocks 117 and the middle recesses 116 of respective connecting elements 1, and adjusted in position relative to the middle recesses 116, the locating pins 12 can engage one of the locating holes 243, 263 of the support plates 24, 26 to securely fix the support plates 24, 26 to the connecting elements 1. The rounded-off inward ends 241, 261 of the support plates 24. 26 can help corresponding locating pins 12 to move downwards from the locking position to allow the support plates 24, 26 to slide onto respective connecting plates 1 easily. And, the stopping plates 118 can prevent the support plates 24, 26 from sliding past the ends of the connecting elements 116.

From the above description, it can be easily understood that the present office chair has advantages as followings:

1. The armrests and the back are detached from the seat while being packed in factories, therefore various parts of the office chair can be arranged in a packing case in such a way that they occupy less space. Consequently, the cost of storage and transportation can be reduced.
2. The consumers can join the armrests, and the back to the seat easily, and have the fun of DIY after buying the office chair.
3. The back and the armrests can be adjusted in position relative to the seat therefore both the space between the armrests and the depth of the chair can be changed to suit sitters of different body sizes; when a big sitter is sitting on the chair, he/she won't feel any discomfort caused by narrow space of the seat.
4. The owner of the chair can substitute a back and armrests of different colors and designs for the original ones so that the chair is more attractive and fancy.
5. The locating pins 12 and the locating holes 243, 263 form a relatively secure locking connection of the back and the armrests with the seat, of which an accidental unlocking is rarely possible. Therefore, the chair is safe to use.

What is claimed is:

1. An improvement for an office chair, comprising:

a connecting element fixedly joined to a lower side of a seat of an office chair for detachably securing a back of the office chair and, a support plate extending from the back of the office chair, the support plate having a plurality of locating holes formed therethrough in longitudinally spaced relationship;

the connecting element having a middle recess defined between a pair of side walls and a lateral wall spanning between the side walls, the connecting element having a pair of wing portions respectively extending from the pair of side walls for mounting the connecting element to the lower side of the seat of the office chair, each of the side walls having a plurality of integrally formed tab portions displaced therefrom into the middle recess to define retaining blocks, the plurality of retaining blocks of each side wall forming a channel on a corresponding side of the middle recess between a distal end of each retaining block and the lateral wall for slidably capturing the support plate therein;

the connecting element having a locating pin fitted thereto, the locating pin having a control member affixed to a lower end thereof, the locating pin being biased by a spring to a locking position where an upper end thereof extends into the middle recess, and being displaceable against the spring bias to a disengaged position external to the middle recess responsive to the control member being pulled downwardly;

whereby the locating pin is selectively engageable with one of the plurality of locating holes of the support plate to securely fix the back to the seat after the support plate is inserted in the channels and adjusted in position relative to the middle recess of the connecting element.

2. An improvement for an office chair, comprising:

three connecting elements fixedly joined to a lower side of a seat of an office chair for detachably securing a back, a left armrest, and a right armrest of the office chair, each of the back, the left armrest, and the right armrest respectively having a support plate extending therefrom, each of the support plates having a plurality of locating holes formed therethrough in longitudinally spaced relationship;

each of the connecting elements having a middle recess defined between a pair of side walls and a lateral wall spanning between the side walls, the connecting element having a pair of wing portions respectively extending from the pair of side walls for mounting the connecting element to the lower side of the seat of the office chairs each of the side walls having a plurality of integrally formed tab portions displaced therefrom into the middle recess to define retaining blocks. the plurality of retaining blocks of each side wall forming a channel on a corresponding side of the middle recess between a distal end of each retaining block and the lateral wall for slidably capturing a corresponding support plate therein;

each of the connecting elements having a locating pin fitted thereto, each locating pin having a control member affixed to a lower end thereof, each locating pin being biased by a spring to a locking position where an upper end thereof extends into a corresponding middle recess, and being displaceable against the spring bias to a disengaged position external to the corresponding middle recess responsive to a respective control member being pulled downwardly;

whereby each of the locating pins is selectively engageable with one of the plurality of locating holes of a corresponding support plate to securely fix the corresponding support plate to the seat after the corresponding support plate is inserted in respective channels and adjusted in position relative to the middle recess of the corresponding connecting element.

3. The improvement for an office chair as claimed in claim 2, wherein each of the support plates have a rounded off portion at a distal end thereof for displacing a corresponding locating pin downwardly from the locking position to assist sliding movement of the support plate into a corresponding connecting element.

* * * * *